United States Patent [19]

Mazier et al.

[11] 3,939,664

[45] Feb. 24, 1976

[54] LARGE DIAMETER TUBULAR PILES AND THE BEDDING THEREOF

[75] Inventors: Georges Mazier, Avon; Jean Paul Geffriaud, Croissy-sur-Seine; Daniel Gouvenot, Clichy, all of France

[73] Assignee: Solmarine S.A., Paris, France

[22] Filed: July 3, 1974

[21] Appl. No.: 485,705

[30] Foreign Application Priority Data

July 9, 1973 France ..... 73.25034

[52] U.S. Cl. ..... 61/53.58; 61/41 R; 61/53.74

[51] Int. Cl.[2] ..... E02D 23/16; E02D 5/22

[58] Field of Search ..... 61/41, 53.52, 53.66, 53.58, 61/40, 53.74, 50

[56] References Cited

UNITED STATES PATENTS

| | | | |
|---|---|---|---|
| 3,064,438 | 11/1962 | Müller | 61/53.58 |
| 3,084,518 | 4/1963 | Hochstrasser | 61/53.58 |

*Primary Examiner*—Jacob Shapiro

*Attorney, Agent, or Firm*—Cooper, Dunham, Clark, Griffin & Moran

[57] ABSTRACT

A large diameter tubular pile for bedding into a borehole has an auxiliary tube extending inside it and a series of axially spaced apart holes through its wall which communicate with the interior of the auxiliary tube through discharge pipes which are arranged to allow flow only from the auxiliary tube to outside the pile. The pile is bedded in a borehole by first inserting the pile and then introducing into the auxiliary tube an injection pipe having a pair of axially spaced apart plugs which seal against the inner wall of the auxiliary tube. The injection pipe is located so that the plugs seal on opposite sides of an opening into a discharge pipe, and grout under pressure is forced from the injection pipe through the discharge pipe into the borehole around the pile. This procedure may be repeated for the other discharge pipes.

6 Claims, 4 Drawing Figures

LARGE DIAMETER TUBULAR PILES AND THE BEDDING THEREOF

The present invention refers to bedding into the ground of metal tubes of relatively large diameter, intended to undergo heavy alternating compressive-tensile forces.

Present methods do not enable this work to be carried out with unerringly satisfactory results. In short the conventional method consists in filling the annular space between the borehole and the metal pile with a cement-base grout put in position by simple gravity. It is known that this way of going about it does not enable complete coating of the metal tube because caving in of the borehole is always possible during the course of filling. For this reason there is a risk of the cementation not being uniform. Further, the lateral friction thus obtained is very low and it is necessary in order to withstand the forces to have very large holds, that is to say, very deep boreholes which cannot always be achieved under good conditions, particularly in marine locations.

The essential object of the present invention is to correct these disadvantages and for this purpose it proposes bedding the tube by means of a method employing an injection grout put in position by pressure, which generates lateral friction very much higher than that obtained conventionally. The product achieved therefore keeps the holds reasonable. Further, the coating is ensure by grout enveloping the whole lateral surface of the tube, which after setting protects this tube against corrosion.

As far as concerns bedding of metal elements in boreholes of relatively small diameter it has already been proposed (see, for example, French Pat. No. 1,539,176 corresponding U.S. Pat. No. 3,494,134, by the Applicant) to furnish them with a special cylindrical member furnished from point to point with orifices provided with a non-return valve and to proceed to injection by employing an auxiliary pipe which can slide in this special member and is furnished with outlet orifices lying between two plugs sliding in the said member with a seal to it.

When it is a question as in the case of the present invention, of bedding tubes the diameter of which is of the order of 1000 to 1500 millimeters over lengths which may reach and even exceed 30 to 50 meters, such a method is not employable in practice for the following reasons:

difficulties of execution because the bedding grout must always have a speed of flow sufficient for no motionless zone to appear and favour setting of the grout. With plugging chambers having a diameter of the order of magnitude aforesaid this risk is very high;

difficulty of achieving non-return device the full bore of the tube;

for a bedding-tube of great length it is obligatory to proceed by joining up shorter tubes, The joint zones (generally by welding) are dangerous to the plugs because they exhibit burrs which deteriorate these members;

the forces exerted on the plugs can reach several hundred tons if the plug chamber (in which the grout is put under pressure) exhibits a large cross-section.

In accordance with the invention with a view to solving these difficulties there is added to the tube to be bedded, or main tube an auxiliary injection-tube of smaller diameter, which is arranged in the main tube and communicates with openings arranged in the latter, by means of sidepipes furnished with non-return valves. Injection proceeds by means of a double-plug pipe cooperating with the auxiliary tube, which gives rise to no difficulties.

This method is employable whatever the nature of the ground, in contrast to methods of manufacture of piles with enlarged feet, which can only be produced in cohesive ground.

Injection of the grout under pressure enables the mechanical properties of the ground to be employed to best advantage and by impregnation and consolidation the characteristics of it even to be improved.

Furthermore one can proceed by repeated injections which may be separated by any intervals of time. In particular this may be very interesting in the event of damage being caused to the bedding.

The injection device enables very viscous grouts to be employed.

The description which follows in respect of the attached drawing given by way of non-restrictive example will let it be clearly understood how the invention may be realized.

Figure 1:
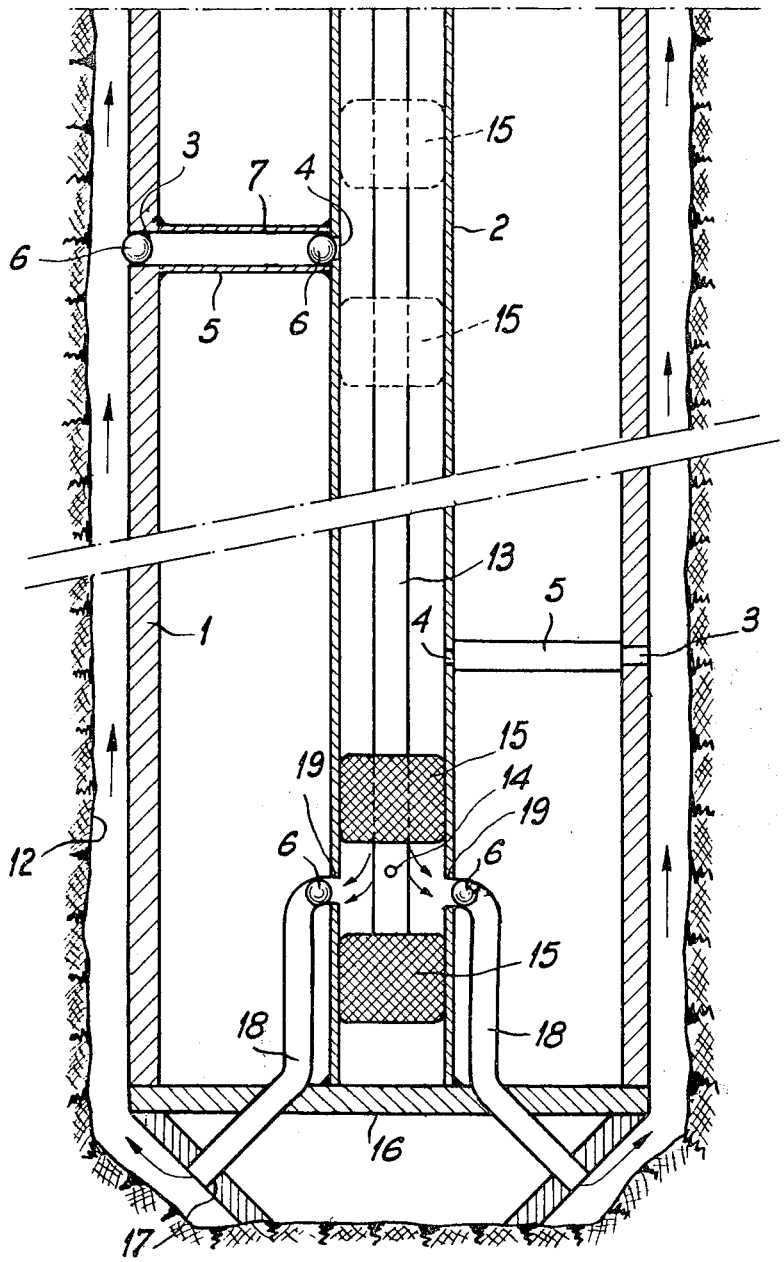
FIG. 1 is a fundamental diagrammatic view in longitudinal section of a tubular pile in accordance with the invention.

Inside the tube 1 to be bedded is arranged an auxiliary injection tube 2. This tube may be coaxial with the tube 1. It may also be eccentric if the internal volume of the tube 1 must be kept clear. A number of auxiliary tubes might also be provided.

From point to point the main tube 1 is drilled with orifices 3 with which correspond orifices 4 arranged in the auxiliary tube 2 and these orifices are connected together in pairs by sidepipes 5.

Each of the pipes 5 is furnished with a non-return valve 6 enabling flow of the injection grout from the auxiliary tube towards the outside of the main tube. This valve might, for example, consist of a ball mounted by forcing it into the orifice 3, which would be ejected during injection. It might also be associated with the orifice 4.

Figure 3:
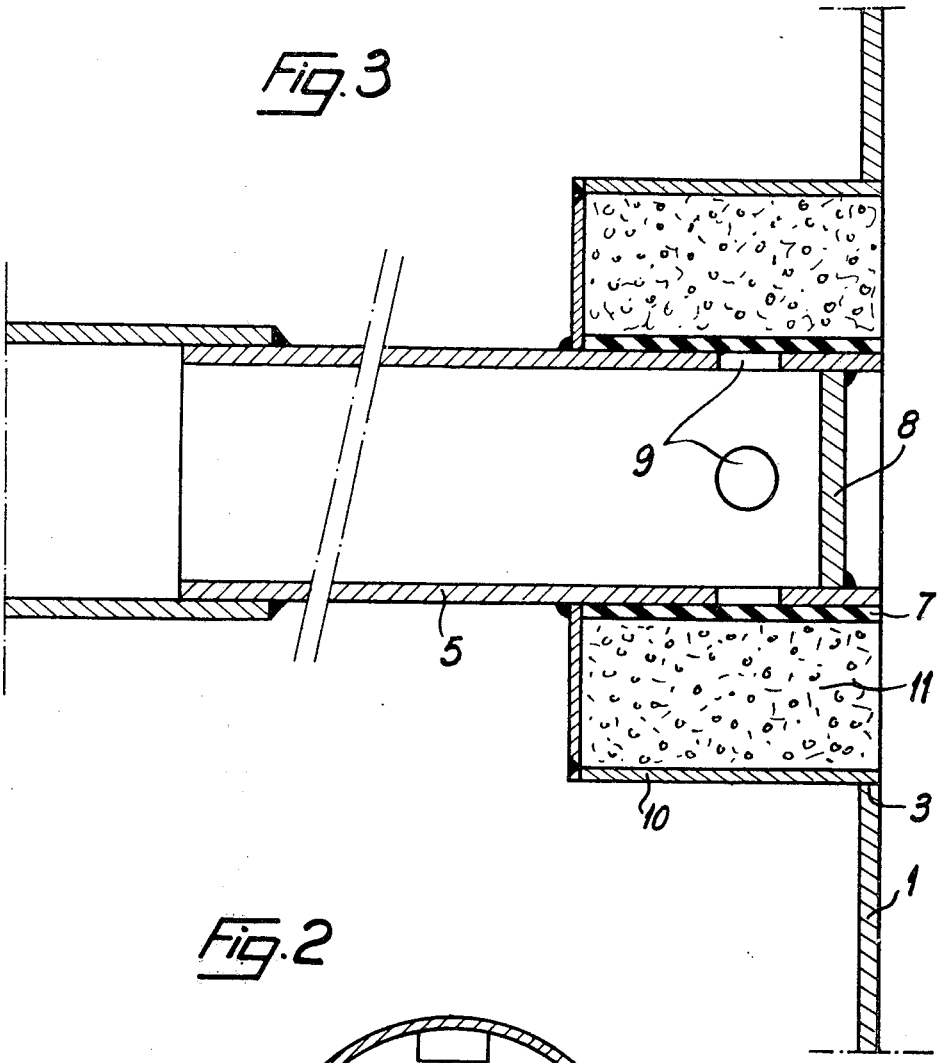
FIG. 3 is a partial view on a larger scale along III—III in FIG. 2.
Figure 2:
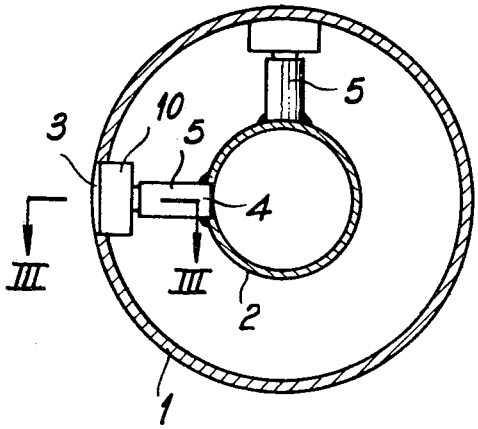
FIG. 2 is a transverse section of one embodiment of the pile.

In the embodiment as FIGS. 2 and 3 it is formed by a sleeve 7 of rubber or like elastomer which surrounds the portion of the channel 5 next to the wall of the tube 1. The said portion is blocked at its end by a plug 8 and drilled a little in front of this plug with holes 9 which the sleeve covers, The sleeve is seated in a housing 10 the annular end of which is welded to the channel 5 and the edge of which is welded to the tube 1 round the orifice 3. The space lying between the sleeve 7 and the housing 10 is lined with foam 11 of rubber or like compressible material.

When the tube 1 is lowered into the borehole 12 nothing can enter the channel 5. In order to inject the grout there is introduced into the tube 2 an injection pipe 13 of diameter smaller than this tube. The pipe 13 is drilled with orifices 14 arranged between two plugs 15 fixed to the pipe 13. The pipe 13 is stopped so that the plugs are located respectively above and below the orifice 4 and the grout is sent in under pressure and leaves through the orifice 3 by separating the sleeve 7 from the holes 9. In the reverse direction the sleeve prevents the return of the grout. This process of injection may be repeated.

In practice the auxiliary tube 2 is connected to the main tube by channels 5 arranged from point to point, for example, every meter and with an angular offset of 90°.

In the bottom portion of the tube 1 the auxiliary tube 2 may be welded to a tip 16 likewise welded to the tube 1.

This tip of convergent shape is drilled with lateral orifices 17 which channels 18 furnished with non-return valves 6 connect with injection orifices 19 in the tube 2. That enables injection of grout to proceed into the bottom of the borehole, by means of the double-plug pipe as shown in FIG. 1. The employment of the double-plug pipe enables the grout to be sent into one radial pipe 5 and one only.

In this way the amounts injected into each of the horizons can be checked. Treatment of every meter of ground is perfectly ensured. In other words: the quality of the bedding can be verified, for example, every meter. Checking of the pressure enables the behaviour of the ground to be supervised and its consolidation followed.

The grout employed may be either a cement grout or a mixture of resin and cement, and in general any material capable of existing in the fluid state for several hours and which after setting reaches high strength.

After setting, these grouts have very interesting mechanical characteristics.

Instead of obtaining quite simply a metal tube surrounded by an irregular and unchecked skin of cement (the result obtained with the conventional method) the method which is the object of the invention leads to a metal pile surrounded by a bedding bulb which may reach several times the diameter of the initial borehole.

Further, at the periphery of the bedding bulb the ground is improved by the effect of the injection under pressure. One therefore finds oneself in the presence of a foundation very different from that which is obtained by the previous technique.

The invention is capable of numerous applications.

Figure 4:
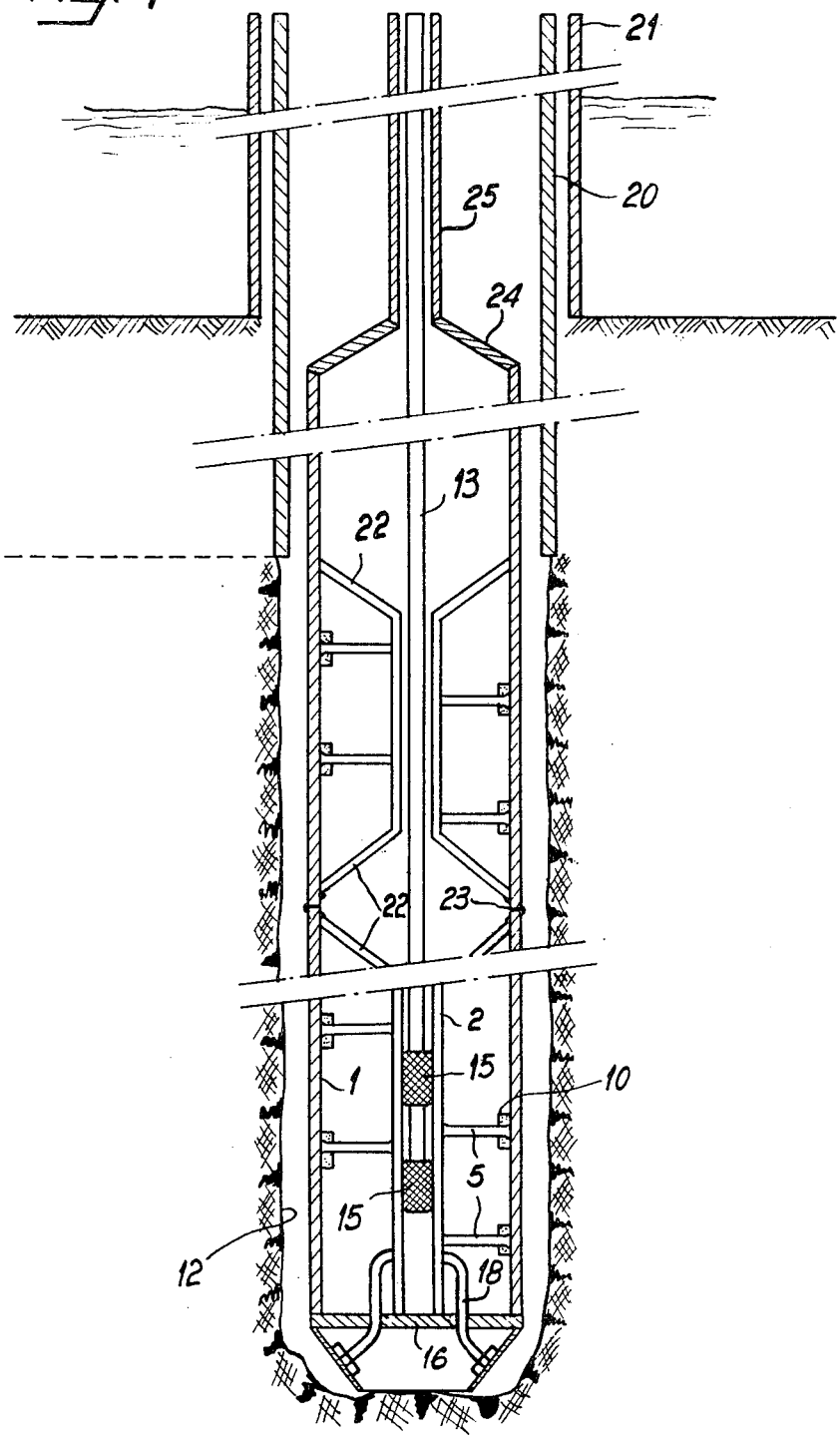
FIG. 4 is an assembly view in section illustrating one possibility of application of the invention.

FIG. 4 shows by way of non-restrictive example an important application which is that of the foundations of fixed platforms for drilling at sea.

One starts by driving a primary tubular pile 20 through the framework of the structure of the platform, inside a guide sleeve 21 welded to the framework (not shown).

When the limit of progress of driving is reached the borehole 12 is carried out through the driven pile and continued at the bottom of this pile.

Next, the combination, of tubes 1 and 2 which has been described is lowered into the borehole. This combination is produced by successive sections in which the sections of the auxiliary tube 2 are connected to those of the tube 1 by funnel-shaped end-pieces 22, welding being effected at 23 without putting any obstacle in the way of the plugs 15 on the injection pipe 13.

The top of the tube 1 is connected by a reducing member 24 to a pipetrain 25 used for lowering the assembly and allowing the double-plug injection-pipe 13 to pass down. After injection of the grout to the outside of the tube 1 by means of the channels 5 and 18 an extremely solid bedding is obtained.

The means employed for achieving this bedding are very small and the operation may be performed from the platform itself, which screens it from meteorological conditions which are often difficult at sea.

Application of the method can likewise be envisaged on a dry-land site, for example, for large-diameter piles subject to alternating working, the base of which rises above a very hard substratum.

The method gives the possibility of avoiding drilling in hard ground, which is very costly. In addition, the foundation obtained by bedding under pressure can, in contrast to ties or to reinforced concrete piles, work with small holds in tension as well as in compression or under horizontal forces, because it is the bedded tube which withstands the forces of any nature applied by the superstructure (horizontal forces, axial compressive forces, axial tensile forces). On a marine site every structure subjected to the aforesaid forces can depend on the application of the invention as regards its foundations.

It goes without saying that modifications may be applied to the embodiment which has just been described, especially by substitution of equivalent technical means, without thereby departing from the scope of the present invention.

We claim:

1. A method of bedding a main tube of relatively large diameter in a borehole, comprising adding to the main tube to be bedded an auxiliary injection-tube of smaller diameter arranged in this main tube and which communicates with openings from the latter by means of sidepipes furnished with non-return valve means enabling the flow of an injection grout only from the auxiliary tube towards the main tube, and injecting grout into the borehole through said pipes and said openings by introducing into the auxiliary tube and injection-pipe having plugs which are arranged on opposite sides of a side pipe through which the grout is to flow.

2. A tubular pipe device adapted to be bedded in a borehole comprising in combination: a main tube provided with openings; an auxiliary injection tube of smaller diameter than said main tube longitudinally secured within said main tube and provided with openings corresponding to the openings of said main tube; connecting pipes including non-return valve means for ensuring a communication between corresponding openings of said main and auxiliary tubes only from the auxiliary tube towards the main tube; and an injection pipe, adapted to be slid within said auxiliary tube and provided with one or more openings located between plugs fitting tightly within said auxiliary tube, to enable a grout to be selectively injected from said injection pipe into the space between plugs in said auxiliary tube and thence through one or more of said connecting pipes to a location outside said main tube.

3. A device as in claim 2 characterized in that said non-return valve means comprises an elastic sleeve which surrounds a portion of said side pipe suitably apertured adjacent said sleeve, said sleeve being seated in a housing.

4. A device as in claim 3 characterized in that said housing contains around the sleeve a lining of compressible material.

5. A device as in claim 2 characterized in that the pile is formed of connected sections, the sections of the auxilairy tube being connected together by means of end pieces widened out so as to avoid damaging the plugs on the injection-pipe.

6. A device as in claim 2 characterized in that the bottom portion of the pile includes a convergent tip to which are fixed main and auxiliary injection tubes, said tip including side-openings connected to the auxiliary tube by injection-pipes.

* * * * *